US006384700B1

(12) United States Patent
Craine et al.

(10) Patent No.: US 6,384,700 B1
(45) Date of Patent: May 7, 2002

(54) TOWED ANTENNA SYSTEM RIGHT ANGLE FEED FOR TOWED ANTENNA SYSTEM RAPID DEPLOYMENT CABLE AND TOWED ANTENNA SYSTEM

(75) Inventors: Richard W. Craine, Nutley; Robert C. Ullrich, Clifton; Wolodymyr Mohuchy, Nutley, all of NJ (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 07/379,508

(22) Filed: Jul. 13, 1989

(51) Int. Cl.[7] ..... H01P 3/00
(52) U.S. Cl. ..... 333/240
(58) Field of Search ..... 333/240

(56) References Cited

U.S. PATENT DOCUMENTS 2,966,644 A * 12/1960 Hafner ..... 333/240
3,134,951 A * 5/1964 Huber et al. ..... 333/240
3,566,317 A * 2/1971 Hafner ..... 333/240
4,278,955 A * 7/1981 Lunden ..... 333/240 X

OTHER PUBLICATIONS

Goubau, *Surface Wave Transmission Line*, Radio & Television News, May, 1950, pp. 10 & 11, 333–240.*

* cited by examiner

*Primary Examiner*—Daniel T. Pihulic

(57) ABSTRACT

A towed antenna system employs drop-type dispensing for rapid deployment of a towed element on the end of a cable. The cable has an elastic central conductor, preferably of stranded stainless steel, which stretches to absorb the high tension of the towed element on the cable at the end of payout. The other end of the cable is anchored by a mounting portion in the launcher. A signal is fed from a coaxial signal conductor to the central conductor of the cable by a right-angle feed to a conductive sleeve on the central conductor, in order to avoid placing stress from the cable on the coaxial signal conductor.

14 Claims, 4 Drawing Sheets

TOWED ANTENNA SYSTEM RIGHT ANGLE FEED FOR TOWED ANTENNA SYSTEM RAPID DEPLOYMENT CABLE AND TOWED ANTENNA SYSTEM

FIELD OF THE INVENTION

The present invention relates to the field of towed microwave decoys and more specifically, to an improved system where a decoy is towed behind a high speed aircraft and is provided with a wideband signal for radiation both forward and aft of the aircraft. Among the valuable features of the invention are the cables employed for towing the decoy from a high speed aircraft, the efficient and reliable manner in which the wideband signal is provided to the decoy, the compact and lightweight structure created for the whole system and the extremely rapid system deployment which may be obtained. The deployment of a decoy, such as an antenna, from an aircraft while travelling at high speed involves releasing the antenna behind the aircraft and providing for the antenna to reach a desired, and relatively stable, location relative to the aircraft. The present invention relates to a rapid deployment system and the various system components specifically designed for rapid deployment.

BACKGROUND AND SUMMARY OF THE INVENTION

Towed systems have been employed in various applications which call for the towing of an element of the system, generally a decoy in the form of an active transmitter from an aircraft. Systems such as this pay out a cable from a reel, a procedure which may consume from ten to sixty seconds for a cable length of about 100 meters. The use of a reel was adopted because its controlled payout speed was believed to be necessary to avoid cable damage which would be encountered if the decoy were simply dropped from the aircraft and allowed to "fall" to the end of the cable. Prior attempts to avoid cable damage have focussed either on controlled payout speed or increased strength for the cable. These approaches failed to provide acceptable results. The controlled payout approach has not resulted in rapid deployment. The increases in cable strength have had another problem. It has been found that increases in cable strength result in increased cable weight. However, the increased weight results in a greater mass reaching the "towing" end of the cable and thus requires more strength and an even larger cable diameter. At supersonic speeds, the extra diameter needed to add strength results in such a substantial increase in weight that it is not feasible to solve the strength problem in this manner.

It is desirable to substantially shorten the payout time, for instance to less than 3 seconds. This appears to require abandonment of the reel-type dispenser which is not capable of such rapid payout. Another disadvantage of reel-type dispensers is the weight of the dispensing apparatus. In aircraft of the type having a need for a towed decoy, it is commonly desired to reduce weight to a minimum. Thus, elimination of the reel-type dispenser is desirable.

One possible solution involves employing an elastic strength member in the cable which allows a temporary elongation of the cable as it reaches its full payout. This approach has been found useful for certain applications because the temporary stretching of the cable allows the towed element to accelerate over a somewhat greater period of time than is possible with non-reinforced cable. This approach has however been found unworkable for supersonic applications. The cable, if initially made of a small diameter, stretches too much and actually breaks when supersonic speeds are encountered. Adding diameter to the cable results in greater strength and weight and reduces the amount of elongation at the end of cable payout. The reduction in the amount of elongation is accompanied by a shortened acceleration period (it takes less time for the cable to reach a fully stretched length when the cable is thicker and stretches less) and greater acceleration forces on the cable. As a result, the cable is still subject to breakage in supersonic deployment situations.

According to one aspect of the invention, it is possible to employ drop-type dispensing of the towed element at supersonic speeds and without encountering detrimental cable breakage. It has been found that this can be accomplished through the use of a new design of lightweight cable, even for supersonic deployment. According to this aspect of the invention, a cable design has been developed which becomes permanently elongated as a result of the drop-type deployment, this elongation acting to absorb a substantial portion of the energy of the towed element. The use of a central strength member of stainless steel is one approach which has been found to provide reliable operation.

Another aspect of the invention calls for the provision of a conductive coating around the central strength member and a dielectric coating around at least a portion of the cable's conductive coating. For subsonic speeds it is possible to obtain reliable drop-type operation through the use of an elastic strength member with a conductive coating thereover. For supersonic speeds an energy absorbing strength member avoids breakage problems.

The cable design is compatible with propagation of a surface wave along the length of the cable. This type of waveguide is known as a Goubau line. Reference is made to "Surface Waves and Their Application to Transmission Lines" by Georg Goubau, Journal of Applied Physics, page 1119 et seq., volume 21, November, 1950 for a description of the Goubau line. Additional references which describe the propagation of surface waves along a line include, "Single-Conductor Surface-Wave Transmission Lines" by Georg Goubau at page 619 of the June 1951 Proceedings of the I.R.E.; "On the Excitation of Surface Waves" by Georg Goubau at page 865 of the July 1952 Proceedings of the I.R.E.; and "Design of Cylindrical Surface Waveguides With Dielectric and Magnetic Coating" by T. Bercelli at page 386 of the March 1961 Monograph No. 436E of the Institution of Electrical Engineers. U.S. Pat. No. 4,730,172 entitled "Launcher for Surface Wave Transmitter Lines" describes an in-line signal launcher.

While these references describe the use of Goubau lines for surface wave propagation, there is no indication that a line can be employed to tow a decoy. Moreover, there is no indication as to how a cable can be made which will withstand the stress associated with "end-of-payout" in a drop-type deployment. The present invention provides a Goubau line which is suitable for use as a "drop-type" payout cable for a towed element. The previous attempts to provide a high quality decoy, towed behind a high speed aircraft, have been limited to slow speed payout, restricted beamforming, restricted power and generally lossy transmission, associated with coaxial transmission lines. According to the present invention, there is no need to employ slow payout, there is no need to limit the beamforming options, the available power is greatly improved and the transmission of the signal to the towed element is very efficient.

The invention makes it possible to employ a drop-type deployment of the towed element using a right angle feed arrangement. In previous approaches to signal transmission onto a Goubau line, it has been satisfactory to rely on certain complicated and difficult to manufacture signal feed arrangements. A signal feed used in a prior approach is that disclosed in "A UHF Surface-Wave Transmission Line", by C. E. Sharp and G. Goubau, PROCEEDINGS OF THE I.R.E., January 1953, pages 107–109. Signal feeds of this type, even though representing themselves as being sufficiently strong for their intended applications, are not adequate to withstand the stresses encountered in the environment of the invention.

According to the right angle feed feature of the invention, it is possible to feed the signal onto the line without concern for the strength of the feed arrangement. The feed arrangement is implemented without exposing the feed structure to the axial load imposed on the cable.

It is an object of the invention to provide the necessary apparatus for the implementation of a drop type towed element system where the towed element may include a radiating antenna.

It is another object of the invention to provide a cable which is capable of withstanding the stresses encountered in a drop type towed element deployment.

It is another object of the invention to provide a signal feed arrangement that can be employed regardless of the axial strength requirements of the cable onto which the signal is to be fed.

DETAILED DESCRIPTION OF THE INVENTION

Figure 1:
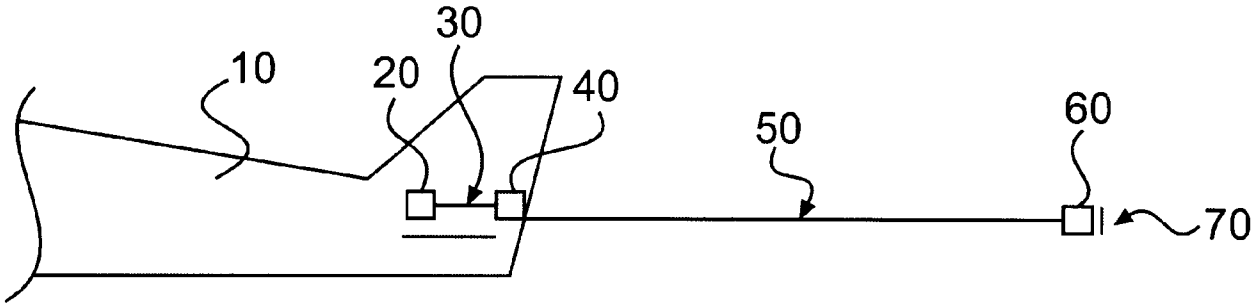
FIG. 1 illustrates a fully deployed towed antenna.

In a general sense, the invention is illustrated in FIG. 1 where a high speed aircraft 10 carries a high frequency signal generator 20 connected via coaxial line 30 to a launching unit 40. The launching unit receives the signal carried on coaxial line 30, converts the signal to a surface wave which is propagated on line 50 to a receiving unit 60. The receiving unit includes means for converting the surface wave to a coaxially-propagated wave which is provided to radiating element 70 for transmission.

The cable 50 is approximately 100 meters in length and transmits the signal propagated in a surface mode along the length of the line with losses of approximately 2 db per hundred feet. While lighter is generally better as an overall design consideration for the cable, it has been found that a 100 meter cable weighing approximately 3 pounds can be fabricated. In operation the aircraft may be travelling at a speed up to or exceeding the speed of sound, i.e. 1.2 mach.

Figure 2:
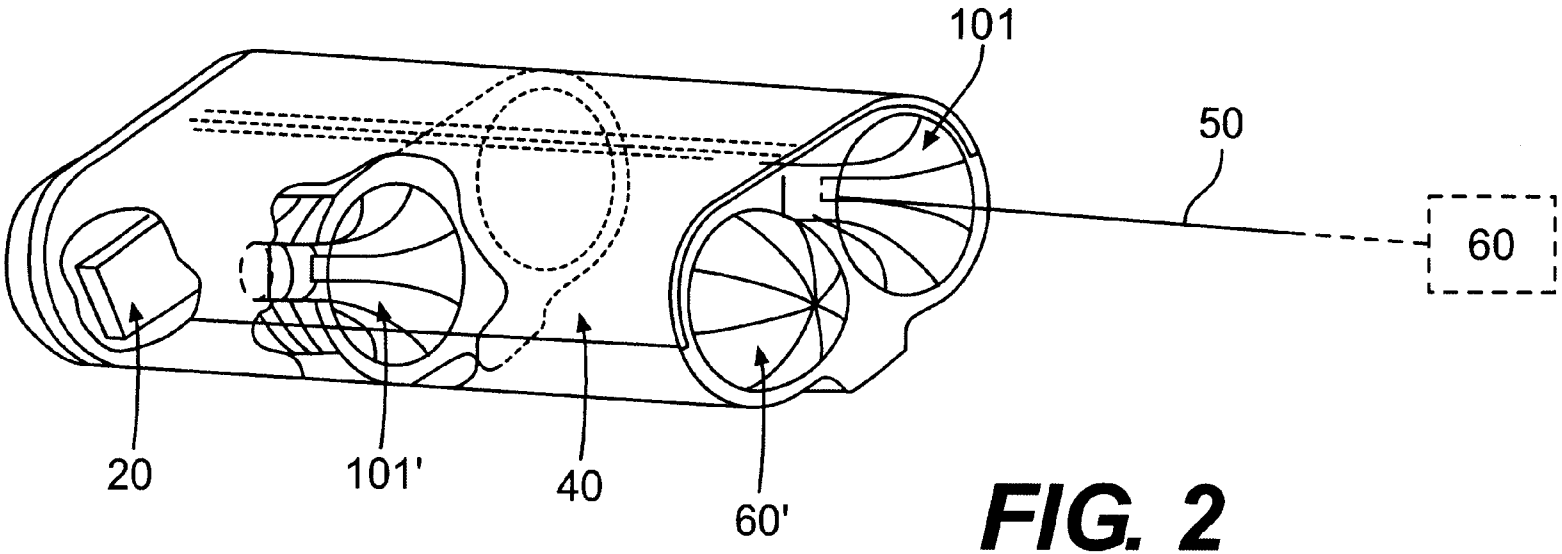
FIG. 2 illustrates an embodiment of the invention having dual towed elements, one of which is stowed and the other deployed.
Figure 3:
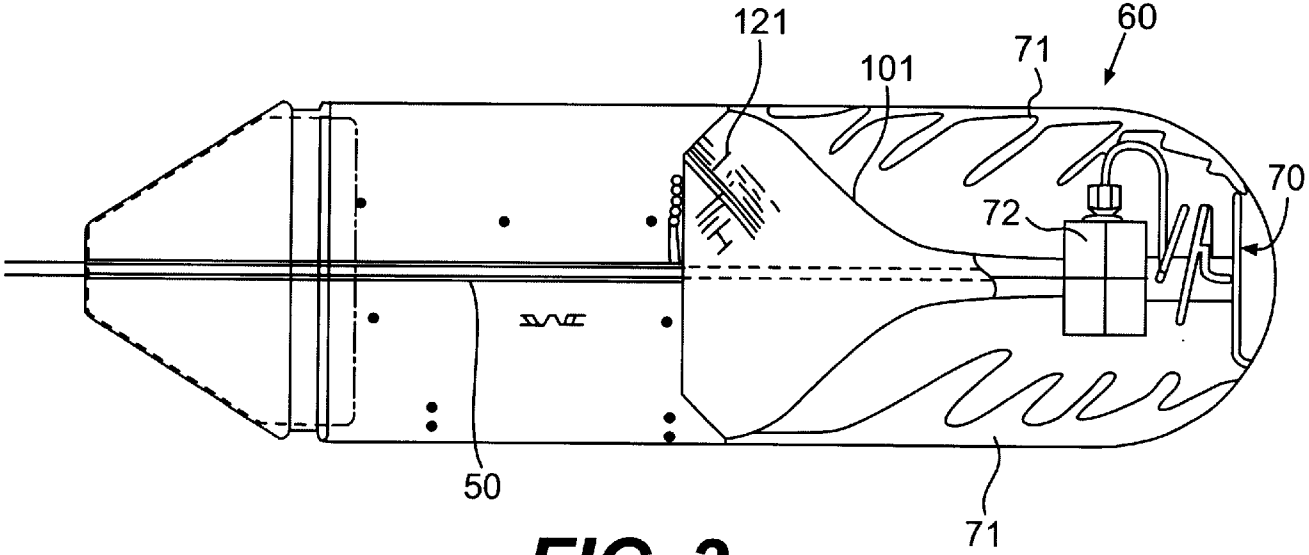
FIG. 3 illustrates a towed element and associated cable in a stowed condition.

In FIG. 2, a self-contained launching member 40 is shown containing the high frequency signal generator 20, dual launchers with surface wave horns 101, 101', and receiving units 60, 60' attached to the launchers via the cable 50. In FIG. 3, the receiving unit 60 is shown in greater detail having a receiver horn 120 with its outer conductor connected to one pole of a radiating antenna 70 by wires 71. The core conductor of the cable 50 is connected through the terminating unit 71 to an opposite pole of the antenna 70.

In the initial configuration, the cable 50 and towed element 60 are stored on the aft section of the aircraft adjacent element 40 and are deployed in a drop type manner. Cable 50 unwinds from its initial coiled position as element 60 falls behind the aircraft. In operation the element 60 achieves a velocity of 250 miles per hour or more (perhaps as much as 450 miles per hour) relative to the aircraft. During this free fall or payout, the tension on line 50 is minimal, perhaps 40 pounds, since the free fall condition only imparts acceleration forces on the cable. The towed element 60 weighs approximately ½ pound and exerts a peak tension of approximately 250 pounds on the cable when the towed element reaches the full payout of cable 50. At "impact" or full payout, the extreme stress (tension) on the line causes the line to stretch.

Figure 5A:
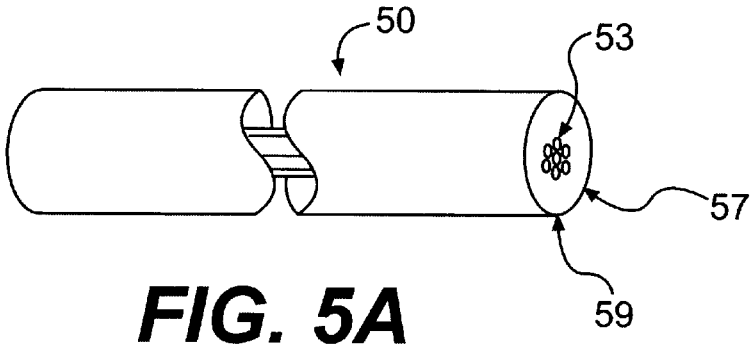
FIGS. 5*a* and 5*b* illustrate the cable of the invention.

The line 50 is a combination of a Goubau line and a Sommerfeld line capable of sustaining transmission losses of less than 2 db per 100 foot of cable. The cable, as shown more thoroughly in FIG. 5*a*, is constructed of a central strength member 53 which may be, for instance, a stainless steel core (0.091 inches) having an aluminum cladding 57 extruded onto the steel core and drawn through a die. A gold flashing 59 may be provided over the aluminum cladding by electro-deposition for instance. It is currently contemplated that the steel core will be stranded to provide maximum flexibility for its total cross-sectional area. It is noted, however, that a stainless steel core (0.150 inches) may also be employed in order to reduce line losses to approximately 1 db per hundred feet. It has been found that core diameters of 1/16 inch to 5/32 inch are practical diameters for this application. Selection of a core having greater than 5/32 inch diameter results in propagation of unwanted modes.

Figure 4:
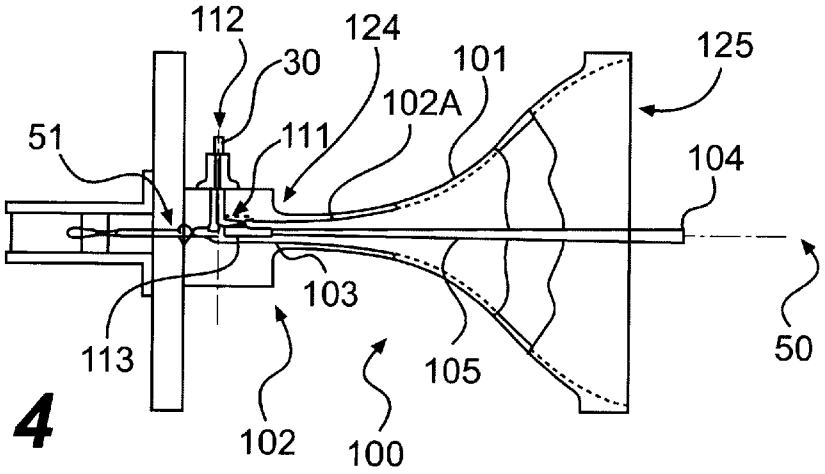
FIG. 4 illustrates, in an expanded view, the right angle feed and signal launching apparatus of the invention.

FIG. 4 illustrates the transition element, shown generally at 100, associated with the launching element 40. In a general sense, a signal arrives via coaxial cable 30, is fed via a right angle feed arrangement 111 onto cable 50 as a coaxial signal and the signal is converted, in the launcher 101 to a surface wave, which is initially propagated along a Goubau line portion and then along the Sommerfeld line portion. The right angle feed arrangement 111 operates to capacitively couple the high frequency signal from the center conductor of cable 30 to the line 50. This is done by providing a sleeve of copper or steel which is closely fit about the line 50. This allows the line 50 to incur all of the axial loading without imparting any axial loading onto the cable 30 or the connection of the cable 30 to the cable 50. The length of the sleeve is 0.25 inches and provides for excellent coupling of the signal onto line 50. This arrangement provides freedom from soldering and/or crimping of the center conductor 112 to the line 50 and in that manner avoids transmission of line stresses through the electrical connection. This results in greatly improved mechanical operation without any associated reduction in electrical performance. Additionally, due to reliance on capacitive coupling, there is no D-C coupling of signals through the feed arrangement.

The cable 50 exits from the surface wave launcher 101 at the end of launcher 101. Surface wave launcher 101 terminates after the surface wave has been fully decoupled from the surface of launcher 101. At the end 102 of the launcher, the launcher surface 102A is an outer conductor of coaxial transmission portion 124. Coaxial line 30 provides the high frequency signal to transition element 100 and includes a right angle feed 111 where the center conductor 112 makes a right angle turn and starts propagation of a coaxial wave along line 50. The center conductor 112 includes a sleeve 113 which fits about cable 50 so as to capacitively couple the high frequency signal onto cable 50. A dielectric coating 114 is provided about line 50 at the Goubau region 105 commencing with 103 and ending at 104. The purpose of this dielectric coating is to confine the energy of the coaxial signal closely about the cable in the coaxial to surface wave transition region 105. Once surface wave transmission has been established in region 105 and the signal has passed beyond the end 125 of horn 101, the dielectric coating is no longer necessary and for reduction of weight, the dielectric coating is eliminated from the entire central portion of the length of the cable. In this central portion of the cable, the wave transmission mechanism is of a type known as Sommerfeld transmission and the central portion of the cable 50 is thus a Sommerfeld line. Thus, the cable operates as a Goubau line at each end, where the signal is launched and received from the transmission line, while the cable operates as a Sommerfeld line over the central portion of its length. This provides the improved signal coupling offered in Goubau lines and the reduced line losses associated with Sommerfeld lines. In the specific application involved here, the benefits of lower line losses and lower weight have combined benefits which do not exist elsewhere.

The launcher 101 is preferably formed of a highly conductive metal such as copper with a nickel coating for physical protection and rigidity. This can be formed by providing a steel mandrel, coating the mandrel with nickel, and coating the nickel with copper. The mandrel is then removed thus providing the nickel-coated copper launcher. In an alternative manner of constructing the launcher, a plastic form may be employed which is plated with copper. This may provide lighter overall weight. Another implementation shown in FIG. 3 for the receiver unit 60, involves the creation of a foam core 121 which is lacquer coated followed by copper electroplating. This technique has the advantage of permitting an extremely thin conductor to be provided over the foam core. The foam core is retained and provides an extremely reliable alignment technique to insure that the cable is held centered within the launcher in the coaxial to surface wave transition region 105.

The cable includes a mounting portion 51 of Kevlar (a Dupont trademark) or other similar high-strength material which is epoxied to the cable 50 and makes up the entire length of the cable behind the right angle feed mechanism. The Kevlar is the strength member and is not conductive; i.e., Kevlar is a good dielectric. The conductive portion of the cable commences at the point of the right angle feed, and near this point, the line is provided with a dielectric coating approximately 0.025 inches thick for facilitating Goubau line transmission. This coating may be of Teflon and commences at the point 103 where the horn 101 starts to taper outward and extends to approximately 2 inches in front of the horn, that is, to a point 104 where the coaxial transmission mode has been totally discontinued in favor of Goubau line transmission. At this point the dielectric coating ends and Sommerfeld line transmission commences.

FIG. 5*a* illustrates a segment of the cable 50 where a 7 strand Kevlar or steel core 53 is provided within an aluminum tube 57. The core has a 91 mil diameter while the aluminum tube has a wall thickness of 15 mils. The 15 mil aluminum tube is drawn about the core through a die. A 750 Angstrom gold coating 59 is provided over the aluminum to provide an inert outer surface. In order to prevent deterioration of the aluminum in the form of aluminum oxide, the aluminum tube is drawn through a cleansing bath which eliminates any aluminum oxide. An oxygen-free environment is maintained up until the time that the gold is electro-deposited. By eliminating oxygen from the environment until after the gold has been provided, formation of aluminum oxide is avoided. An alternative manner of providing the gold coating over the aluminum oxide is by drawing the cable through a gold bath. In either case an oxygen-free environment is employed from the time of aluminum extrusion (or cleansing) to the time of gold coating. If the aluminum is permitted to oxidize, even slightly, before application of the gold coating, the aluminum oxide will flake off resulting in flaking off of the thin gold coating. Since the outer surface of the cable is then an aluminum surface and subject to further oxidation, the integrity of the cable is insufficient. It has been found satisfactory to provide an extremely thin gold coating on the order of 750 Angstroms. Since this is less than 3 skin depths of gold, the gold does not perform any substantial conducting function in the cable but rather merely provides an inert outer coating. This stabilizes the cable at approximately 2 db per hundred feet of cable length for a cable having a core diameter of approximately 0.091 inches.

Figure 5B:
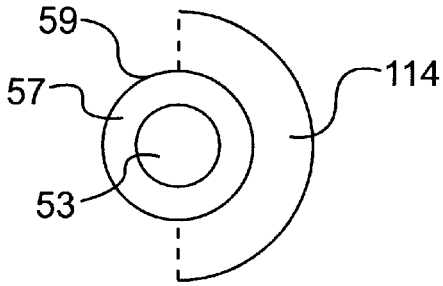

FIG. 5*b* is a cross-section of the cable showing the core 53, aluminum layer 57 and gold coating 59. The right half of the cable is illustrated with dielectric coating 114. The core material in this illustration is 0.091 stainless steel which has been heat treated and is energy absorbing. Steel of this type starts to yield at approximately 5% of rated strength and continues to yield up to 40% to 45% before breaking. This core is preferably stranded, having 7 strands and weighs approximately 1 pound per hundred feet. The highly conductive cladding layer 57 of aluminum surrounds the core. The aluminum coating 57 is flexible and is able to yield 20% or more. The surface of this aluminum is smooth and clean; i.e., free of aluminum oxide. A gold flashing 59 is provided over the aluminum surface, as mentioned above, either by electro-deposition or drawing of the aluminum-clad core member through a gold bath. The cable near the horn (or launcher) 101 includes a dielectric coating 114 having a dielectric constant of about 2.2 and thickness of about 0.025 inches. The function of the dielectric coating is to pull the surface wave tightly about the line to make it an efficient open wave guide. This is a feature of Goubau lines. The dielectric coating 114 provided of Kevlar or other good dielectric results in containing the field within less than a 4 inch diameter centered about the line. The diameter of the horn 101 crosses slightly beyond the 4 inch diameter in order that the transmitted and receiving energy levels are approximately the same since none of the field is beyond the diameter of the horn.

Figure 6:
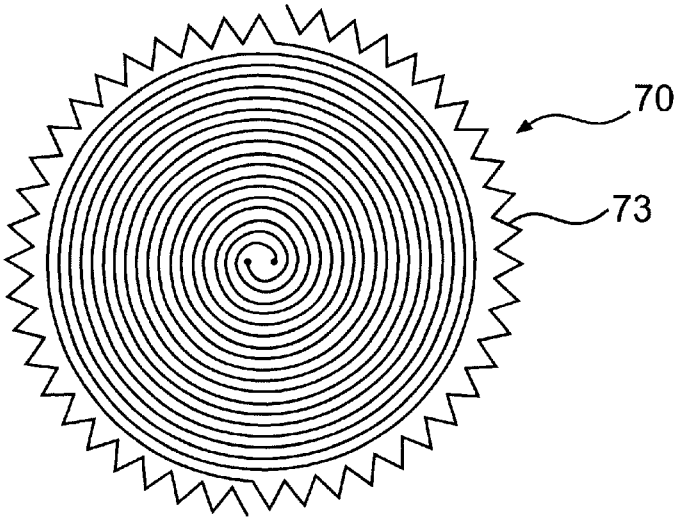
FIG. 6 illustrates the antenna of the invention.

The signal to be propagated along the line has a bandwidth of two octaves in the x-band frequency range. The antenna 70, illustrated in FIG. 6, is a spiral antenna having a zigzag outer loop 73 in order to provide a good impedance match. This antenna provides a radiated signal with circular polarization.

Figure 7:
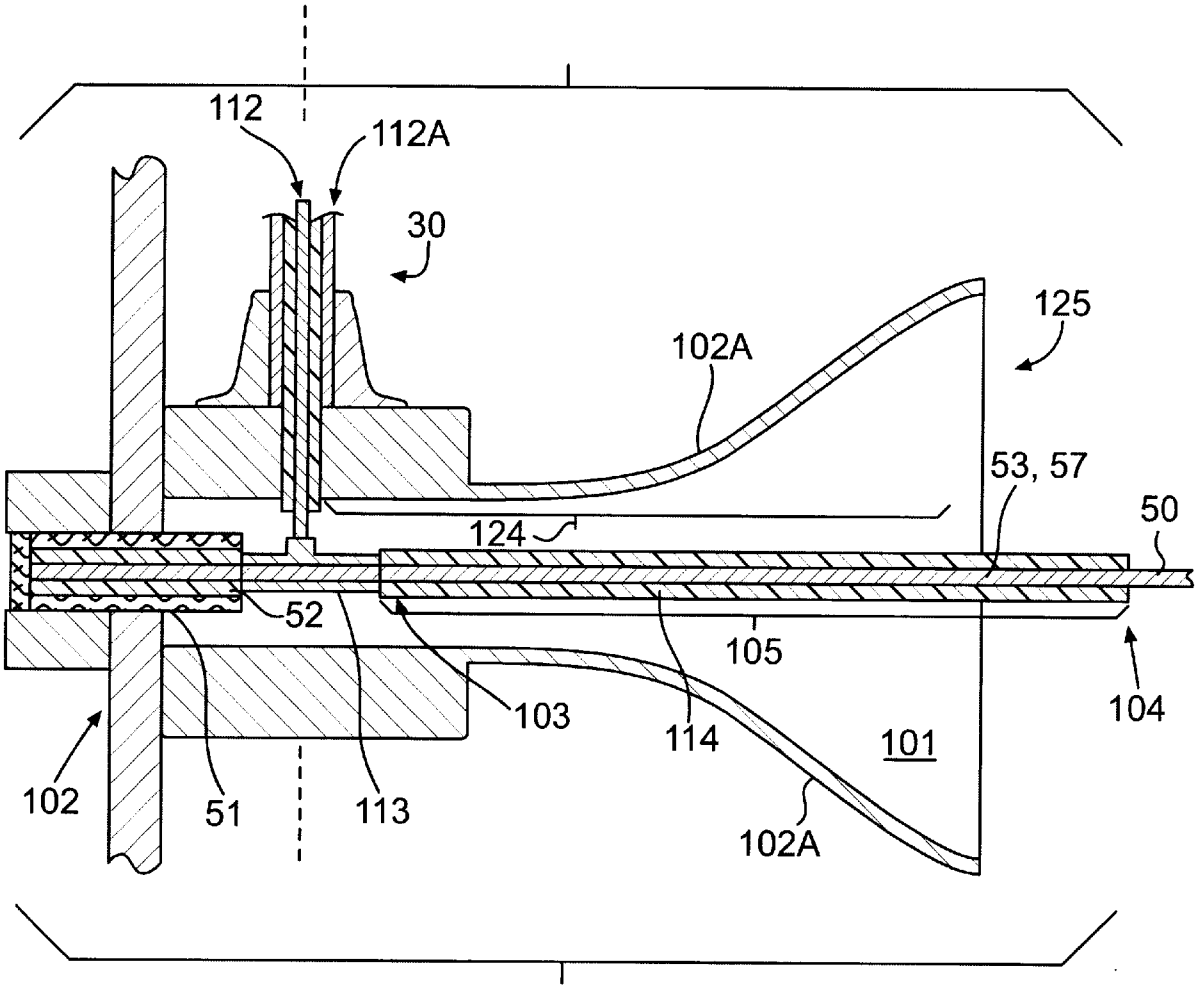
FIG. 7 shows a detailed view of the connection of the coaxial signal line to the transmitting cable.

As shown in more detail in FIG. 7, the coaxial line 30 has its outer conductor 112A electrically in contact with the conductive surface 102A of the horn 101, and its inner conductor 112 electrically connected to the core conductor of the cable 50 by the sleeve 113. The core conductor of the cable 50 is formed by the aluminum cladding layer 57 over the central strength member 53, which may be stainless steel or Kevlar material. The end of the core conductor projecting beyond the sleeve 113 is bonded by epoxy layer 52 to the mounting portion 51, made of a high strength material such as Kevlar, which is anchored by blocks at the end of the launcher. The conductive surface 102A of the horn forms the equivalent of an outer conductor for the core conductor 53, 57 which is sheathed in the dielectric layer 114 in the Goubau region 105. After termination of the Goubau region a slight distance beyond the open end of the horn at point 104, the signal transmission becomes a Sommerfeld transmission line.

While the present invention has been described with respect to various specific implementations of the invention, it is to be understood that the invention resides in the novel design approach rather than in the specific implementation described in this application. It is intended that the patent shall cover not only those implementations specifically disclosed, but also all obvious modifications and extensions thereof as well as the entire range of implementations encompassed by the claims appended hereto and the equivalents thereof.

What is claimed is:

1. In a waveguide coupling arrangement for coupling a signal feed from a coaxial line to a surface wave transmission line formed by a cable of extended length, the improvement comprising:

a waveguide member having a centerline axis, a terminating end at which the cable is terminated, and a conductive horn extending about the centerline axis to an open end thereof from which the cable extends outwardly, said cable being formed with a core conductor;

a mounting portion fixed to one end of the cable at the terminating end of said waveguide member;

said waveguide member having an inlet toward said terminating end for receiving the coaxial line therein at substantially a right angle to said centerline axis;

a fixed connection electrically connecting an outer conductor of said coaxial line with said conductive horn;

a conductive sleeve slidingly fitted over and in electrical contact with the core conductor of the cable, and also electrically connected to an inner conductor of the coaxial line extending at substantially a right angle thereto; and a dielectric layer sheathed over the core conductor of the cable over a signal transition region extending substantially from the position of said sleeve to a selected distance slightly beyond the open end of said horn, wherein said signal transition region exhibits a Goubau transmission characteristic.

2. A waveguide coupling arrangement according to claim 1, wherein said core conductor of said cable includes a conductive cladding over a central strength member.

3. A waveguide coupling arrangement according to claim 1, wherein said mounting portion includes an anchoring strength member made of Kevlar material which is bonded to the terminated end of the core conductor of the cable by epoxy adhesive.

4. A waveguide coupling arrangement according to claim 1, wherein said dielectric layer terminates at said selected distance, leaving the core conductor of the cable exposed, wherein it exhibits a Sommerfeld transmission characteristic.

5. A waveguide coupling arrangement according to claim 2, wherein said central strength member is stranded stainless steel.

6. A waveguide waveguide coupling arrangement according to claim 2, wherein said central strength member is Kevlar material.

7. In a towed antenna arrangement for coupling a signal feed from a coaxial line to a surface wave transmission line formed by a cable of extended length having a signal receiving element and radiating antenna at a distal end thereof, the improvement comprising:

a launcher member having a centerline axis, a terminating end at which the cable is terminated, and a conductive horn extending about the centerline axis to an open end thereof from which the cable extends outwardly, said cable being formed with a core conductor;

a mounting portion fixed to one end of the cable at the terminating end of said launcher member;

said launcher member having an inlet toward said terminating end for receiving the coaxial line therein at substantially a right angle to said centerline axis;

a fixed connection electrically connecting an outer conductor of said coaxial line with said conductive horn;

a conductive sleeve slidingly fitted over and in electrical contact with the core conductor of the cable, and also electrically connected to an inner conductor of the coaxial line extending at substantially a right angle thereto; and a dielectric layer sheathed over the core conductor of the cable over a signal transition region extending substantially from the position of said sleeve to a selected distance slightly beyond the open end of said horn, wherein said signal transition region exhibits a Goubau transmission characteristic.

8. A towed antenna arrangement according to claim 7, wherein said core conductor of said cable includes a conductive cladding over a central strength member.

9. A towed antenna arrangement according to claim 7, wherein said mounting portion includes an anchoring strength member made of Kevlar material which is bonded to the terminated end of the core conductor of the cable by epoxy adhesive.

10. A towed antenna arrangement according to claim 7, wherein said dielectric layer terminates at said selected distance, leaving the core conductor of the cable exposed, wherein it exhibits a Sommerfeld transmission characteristic.

11. A towed antenna arrangement according to claim 8, wherein said central strength member has a stretching capability to absorb tension generated in the cable by drop-type deployment of the receiving element and antenna.

12. A towed antenna arrangement according to claim 11, wherein said central strength member is Kevlar material.

13. A towed antenna arrangement according to claim 11, wherein said central strength member is stranded stainless steel.

14. A towed antenna arrangement according to claim 8, wherein said metal cladding of said core conductor is aluminum having a thin coating of a chemically inert metal formed over the external surface thereof.

* * * * *